United States Patent [19]

Forterre

[11] 4,374,367

[45] Feb. 15, 1983

[54] NON-RECIPROCAL MICROWAVE-FREQUENCY DEVICE FOR HIGH-LEVEL OPERATION

[75] Inventor: Gerard Forterre, Paris, France

[73] Assignee: Thomson-CSF, Paris, France

[21] Appl. No.: 214,659

[22] Filed: Dec. 9, 1980

[30] Foreign Application Priority Data

Dec. 28, 1979 [FR] France ..... 79 31975

[51] Int. Cl.[3] ..... H01P 1/19

[52] U.S. Cl. ..... 333/24.1; 333/158

[58] Field of Search ..... 333/1.1, 24.1, 24.2, 333/24.3, 158

[56] References Cited

U.S. PATENT DOCUMENTS 3,075,159 1/1963 Skomal ..... 333/24.2

4,286,135 8/1981 Green et al. ..... 333/24.2 X

FOREIGN PATENT DOCUMENTS 913324 12/1962 United Kingdom ..... 333/24.2

*Primary Examiner*—Paul L. Gensler

*Attorney, Agent, or Firm*—Cushman, Darby & Cushman

[57] ABSTRACT

A phase-shifting device for microwave frequencies is constituted by a section of a rectangular waveguide, the two large walls of the waveguide being each adapted to carry two strips of gyromagnetic material placed on each side of a strip of dielectric material. Each strip is formed by an array of small plates bonded to the waveguide walls and to each other by means of an insulating silicone adhesive.

3 Claims, 3 Drawing Figures

NON-RECIPROCAL MICROWAVE-FREQUENCY DEVICE FOR HIGH-LEVEL OPERATION

This invention relates to a device based on the non-reciprocity of the electrical characteristics of ferrites within the microwave-frequency range (from a few tens of megahertz upwards) and more particularly to a phase-shifting device which operates at a high mean power level. By high mean power level is meant several tens of kilowatts. The problems presented by the use of ferrites within the microwave-frequency range at high power are well-known and fall into two classes:

(1) The variation in characteristics of the material which define the conditions of propagation (complex permeability in particular) as a function of temperature;

(2) The mechanical behavior of ferrite elements under the action of temperature variations (thermal stresses exceeding the mechanical limits of the material and/or of the devices employed for attaching the elements to the waveguide).

A number of studies have been devoted to this problem and the results achieved have been described in particular in an article entitled: "Thermal stress induced breakdown in an S-band isolator" published in IEEE Transactions on M.T.T. vol. 26, No. 5, May 1978, page 357. As described in the article just mentioned, an isolator is constituted by two phase-shifting cells having a common guide wall of small width; each phase-shifter is composed of two strips of gyromagnetic material arranged symmetrically on each large face, namely four strips per waveguide. A magnetic structure located externally of the waveguides establishes magnetizing fields within these latter, said fields being parallel to the small sides of the waveguides and in opposite directions, between the two pairs of strips of gyromagnetic material which are in oppositely-facing relation within each waveguide. A water-cooling circuit is provided for the removal of heat transmitted by the strips to the waveguide through a flexible adhesive which has been deposited on the waveguide in the form of a thin film. The measurements reported in the aforementioned article relate to a lightened structure provided with two ferrite strips per waveguide. The insertion loss exhibited by the devices studied is 0.25 dB at a mean power level of 50 kilowatts and at a frequency of 2450 MHz. The structure composed of four ferrite strips is designated as a "structure of the type considered".

The high-level performances of a differential phase-shift circulator are described in "Transactions on M.T.T.", May 1978 issue, page 360, in an article entitled: "A 50 kilowatt CW ferrite circulator in S band". This circulator essentially consists of two phase-shift cells of the type considered and of a magic tee, provision being made for only two ferrite strips per waveguide (cf. FIG. 3). It is stated in the aforementioned article that the high-level 90° phase shift is obtained by means of modifications of characteristics resulting from operating conditions, by accepting a low-level phase-shift of 110°. The performances of the device are consequently poor in the cold state.

The present invention is essentially directed to improvements in the structure of a set of two phase-shift cells of the type considered which has four ferrite strips per waveguide and achieves high and constant performances irrespective of the power level at which it operates.

The invention has for its object a phase-shifter having a standing-wave ratio which remains lower than 1:1 with a matched load and lower than 1.35 on short-circuit up to 50 kilowatts maintained at 2450 MHz; the insertion loss remains lower than 0.16 dB while permitting the use of waveguide sections which are obtained by molding of aluminum, thus entailing lower capital outlay than machined parts and being of distinctly lighter weight (reduction of nearly 40%).

The distinctive feature of the invention lies in the fact that the two strips of gyromagnetic material placed on the same large wall of each waveguide are constituted by an assembly of elements having small dimensions in the vicinity of the width of said strips and placed on each side of a dielectric strip, said dielectric strip being also constituted by an assembly of elements and located in the plane of symmetry of the waveguides in parallel relation to the small waveguide walls.

In a preferred alternative embodiment of the invention, the elements aforesaid are bonded to the walls of the waveguide and to each other.

These and other features of the invention will be more apparent upon consideration of the following description and accompanying drawings which are given solely by way of illustration without any limitation being implied, and in which.

Figure 1:
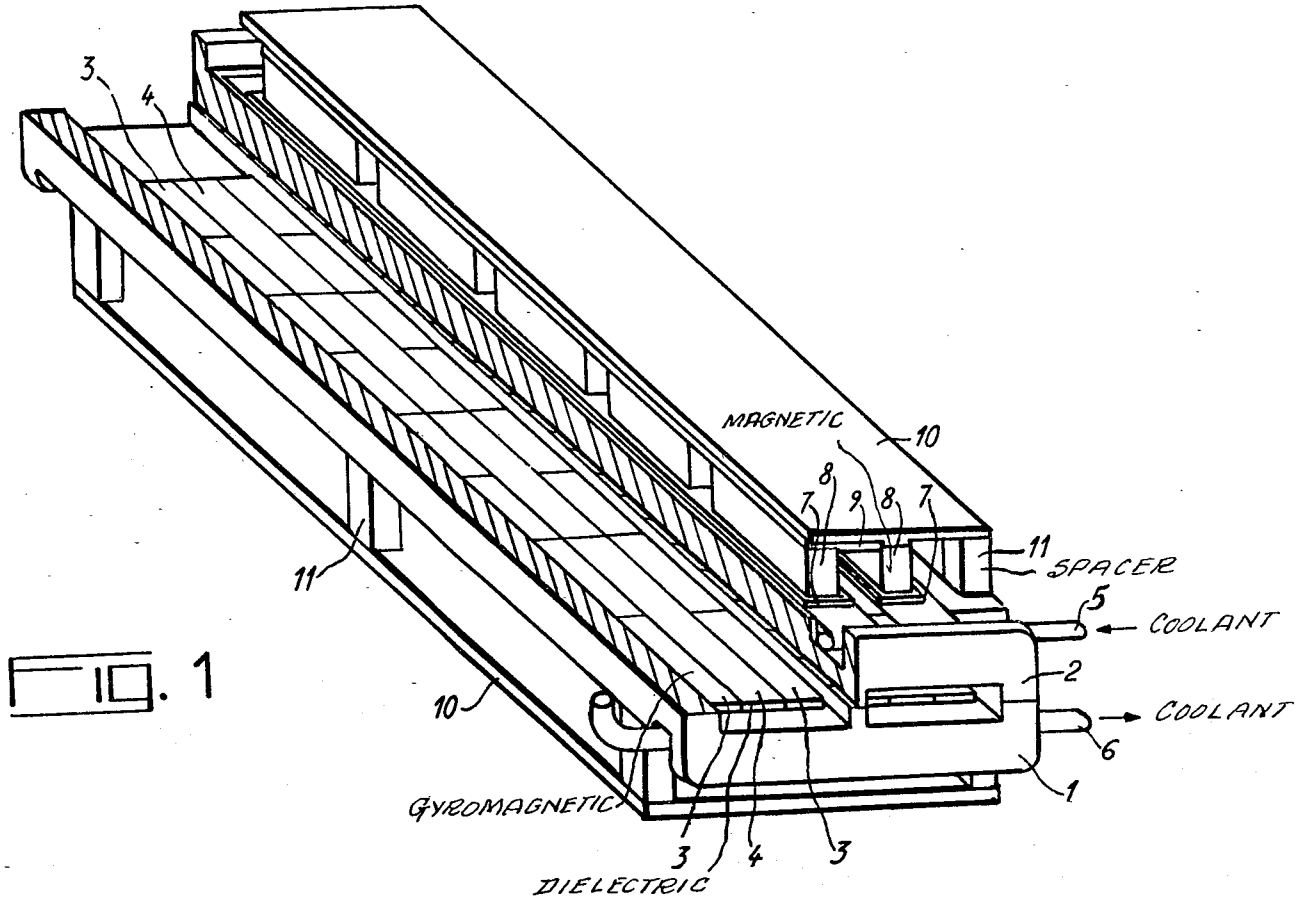
FIG. 1 is a part-sectional view in isometric perspective showing a phase-shifter in accordance with the invention.

FIG. 1 is a perspective view of a phase-shifter in accordance with the invention, this view being partially cut-away in the right half of the figure in order to provide a view of the interior of one of the waveguides. As mentioned earlier, the phase-shifter is constituted by two rectangular-section waveguides placed side by side along one of the small walls. These waveguides are delimited by the two E-shaped members 1 and 2 which are placed one above the other. The left half of the member 2 is cutaway. The two large walls of the waveguides are covered by an array of small plates which are visible on the left-hand side of the figure. Said small plates are either of gyromagnetic material such as the plates 3 or of dielectric material such as the plates 4. As is apparent from the sectional view of FIG. 2, practically the entire surface is covered. The small plates 3 and 4 are rectangular and the width of these latter is defined by the distribution of the microwave-frequency magnetic field within the waveguide. Said width is chosen so as to ensure that, when the gyromagnetic material is centered on the plane of circular polarization, said material occupies the zone in which at least 10% of the microwave-frequency magnetic field is circularly polarized. In other alternative embodiments, this zone may be smaller and the ferrite extends on each side of the circular-polarization plane over a zone in which at least 20% of the field, for example, is circularly polarized. The width of the small plates 4 is chosen so as to occupy the space between the two strips constituted by the small plates 3. Said small plates can have either different lengths as in the embodiment shown in the figure or equal lengths, the lengths being determined by mechanical conditions related to their coefficient of expansion. The materials are chosen so as to have the same permittivity in accordance with well-known practice. The small plates 3 and 4 are fixed on the waveguide wall by means of a joint of insulating silicone adhesive of minimum thickness (a few hundredths of a millimeter). The adhesive fills the joints between the elements and thus constitutes an expansion joint between said elements, thus considerably reducing the dangers of mechanical failure. The array of small plates 3 and 4 thus constitutes a checkerboard which covers the large walls of the two waveguides almost entirely. Ducts for the circulation of coolant fluid are provided within the thickness of the sectional members 1 and 2 and supplied through the fluid inlet and outlet 5 and 6. Pole-pieces such as those designated by the reference numeral 7 and formed of soft iron strips having the same length as the phase-shifter and the same width as the small plates 3 are placed on each side of the sectional members 1 and 2 opposite to strips constituted by said small plates 3. The design function of said pole-pieces is to ensure that the magnetic field produced by the magnets 8 is made uniform. A yoke 9 consisting of a soft iron strip having the same length as the phase-shifter closes the magnetic field between the two series of magnets 8 located on one and the same side of a waveguide. A protective plate 10 of aluminum, for example, and spacer members 11 formed of the same metal constitute a casing. The coupling flanges 12 (cf. FIG. 3) are constituted by enlarged end portions of the members 1 and 2.

Figure 2:
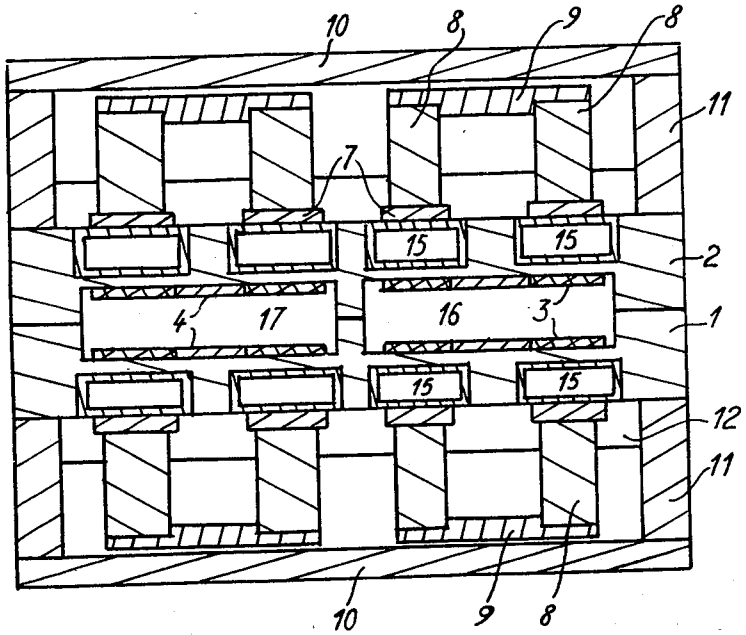
FIGS. 2 and 3 are sectional views taken respectively along a plane at right angles to the axes of the waveguides and along a plane containing the axes and at right angles to the preceding.
Figure 3:
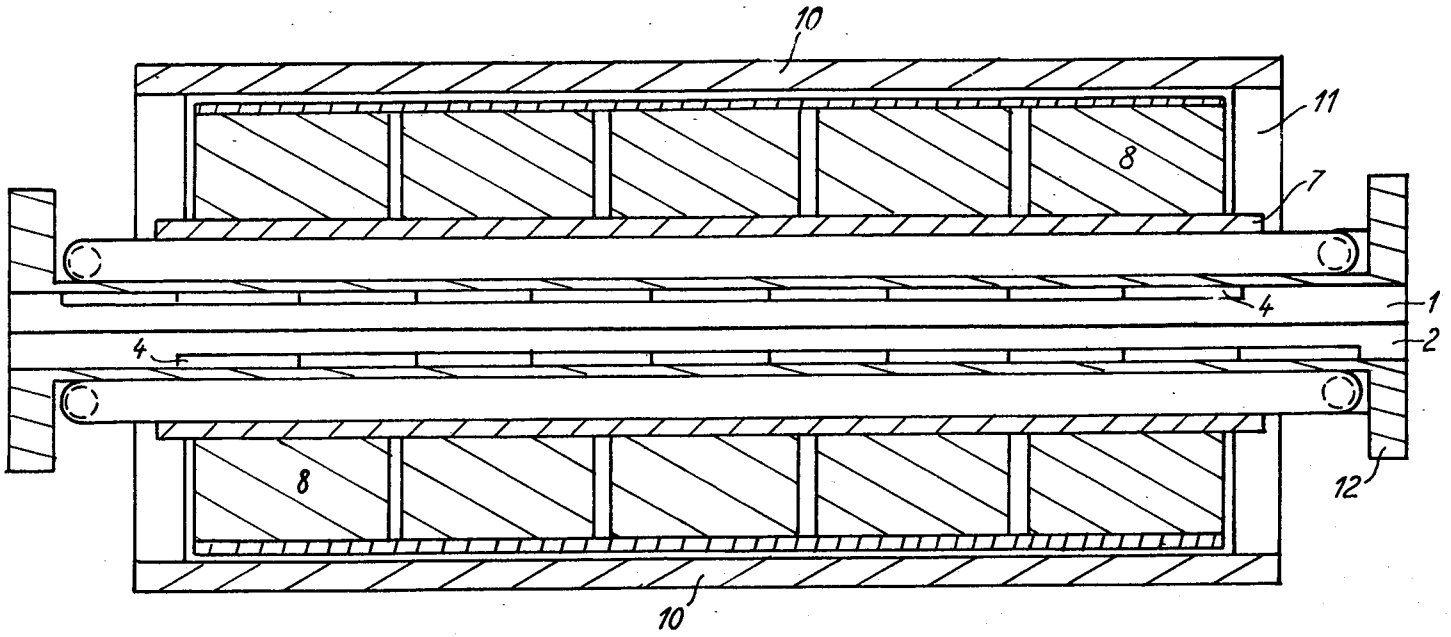

The sectional view of FIG. 2 provides a clearer illustration of the relative arrangements of the components mentioned in the foregoing. The ducts for the circulation of coolant fluid are shown at 15. The propagation volumes delimited by the members 1 and 2 are designated by the reference numerals 16 and 17. As shown in the longitudinal sectional view of FIG. 3, the checkerboard arrays which are bonded to the top and bottom walls are relatively displaced to a slight extent in a direction parallel to the axis of the waveguides in order to provide enhanced matching. In a particular embodiment of a phase-shifter in accordance with the invention as constructed and designed to operate within the 2450-MHz band, the small plates were made of gyromagnetic material Type 2113 supplied by the Trans-Tech Company of Gailherburg, Maryland and served to form strips measuring $25 \times 388$ mm$^2$. The dielectric employed was of Type D 16 provided by the Trans-Tech Company. The performances of this embodiment mounted as a circulator with a magic tee and a 3-dB coupler are as follows:

(1)-at low level: between 2440 and 2460 MHz
insertion loss $\leqq 0.2$ dB between gates 1 and 2
standing-wave ratio $\leqq 1.05$ gates 1 and 2
decoupling
$>33$ dB between gates 1 and 4
$>33$ dB between gates 1 and 3
$>33$ dB between gates 2 and 1

(2)-at high level (cooling water flow rate of 5.5 liters/-minute maximum).

| level applied Gate No 1 (Kilowatt) | Matched load Gate No 2 | | Short-circuit Gate No 2 | |
|---|---|---|---|---|
| | Insertion loss of phase-shifter | Decoupling 1–4 | Insertion loss of phase-shifter | Decoupling 1–4 |
| 21 | 0.165 | 26.5 | | |
| 27 | | | 0.17 | 23.7 |
| 33 | | | 0.16 | 23 |
| 39.5 | | | 0.16 | 21 |
| 41.95 | 0.166 | 25.4 | | |
| 44 | | | 0.155 | 19.2 |
| 49.3 | 0.172 | 23.7 | 0.16* | 18.4* |

*for this measurement alone, the water flow rate is 10 liters/minute and the operating time is 35 minutes.

What is claimed is:

1. A non-reciprocal phase-shifter operating within the microwave-frequency range at a high mean power level and comprising:

at least one rectangular-section waveguide;

at least four longitudinal members of gyromagnetic material mounted within the waveguide and arranged symmetrically in pairs on each of the large walls of the waveguide;

a magnetic circuit for producing magnetizing fields in opposite directions parallel to the small walls of the waveguide within an internal space which includes said four members of gyromagnetic material, each member of gyromagnetic material being constituted by a first array of small parallelepipedal gyromagnetic plates which have the same thickness as well as the same width and the longitudinal axes of which coincide, said gyromagnetic plates being bonded to the waveguide walls by an insulating silicon adhesive, two members of gyromagnetic material located on one and the same wall of the waveguide being placed on each side of at least one member of dielectric material centered on the mid-plane of the waveguide, said dielectric member being constituted by a second array of small parallelepipedal dielectric plates having the same width and a thickness equal to the thickness of said small gyromagnetic plates, the small dielectric plates being so arranged that their longitudinal axes coincide, said dielectric plates being bonded to the waveguide walls and to said gyromagnetic plates by an insulating silicone adhesive.

2. A phase-shifter according to claim 1, wherein the width of said small dielectric plates is equal to the distance between two small gyromagnetic plates located on the same wall of the waveguide, the small gyromagnetic plates being placed symmetrically with respect to the plane of circular polarization of the microwave-frequency magnetic field.

3. A phase-shifter according to claim 1, further including fluid circulation ducts mounted within the thickness of the waveguide.

* * * * *